US007048573B2

(12) United States Patent
Masaki et al.

(10) Patent No.: US 7,048,573 B2
(45) Date of Patent: May 23, 2006

(54) PLUG-TYPE CONNECTOR AND ELECTRIC CONNECTOR COMPRISING THE SAME

(75) Inventors: Katsuyuki Masaki, Kanagawa (JP); Yusuke Hamada, Kanagawa (JP)

(73) Assignee: J.S.T. Mfg. Co., Ltd., Osaka (JP)

( * ) Notice: Subject to any disclaimer, the term of this patent is extended or adjusted under 35 U.S.C. 154(b) by 0 days.

(21) Appl. No.: 10/860,135

(22) Filed: Jun. 4, 2004

(65) Prior Publication Data

US 2004/0248460 A1 Dec. 9, 2004

(30) Foreign Application Priority Data

Jun. 9, 2003 (JP) ..... 2003-164056

(51) Int. Cl.
*H01R 12/24* (2006.01)

(52) U.S. Cl. ..... 439/492

(58) Field of Classification Search ..... 439/492, 439/701, 579, 497, 607, 610, 494, 498, 857, 439/668, 637, 540.1, 660, 636
See application file for complete search history.

(56) References Cited

U.S. PATENT DOCUMENTS 6,273,753 B1 * 8/2001 Ko ..... 439/579
6,520,810 B1 * 2/2003 LePottier et al. ..... 439/701
6,860,755 B1 * 3/2005 Wang et al. ..... 439/498

FOREIGN PATENT DOCUMENTS

| | | | |
|---|---|---|---|
| EP | 0 791 983 | A2 | 8/1997 |
| EP | 0 791 983 | A3 | 9/1997 |
| EP | 1 233 477 | A2 | 8/2002 |
| EP | 1 235 304 | A1 | 8/2002 |
| EP | 1 233 477 | A3 | 12/2003 |
| JP | 11-329619 | A | 11/1999 |

OTHER PUBLICATIONS

European Search Report Dated Sep. 27, 2004.

* cited by examiner

*Primary Examiner*—J. F. Duverne
(74) *Attorney, Agent, or Firm*—Rader, Fishman & Grauer PLLC

(57) ABSTRACT

A plug-type connector for connecting an FFC. The connector is provided with: a holder including a placing plate on which an end portion of the FFC is placed as temporarily held; and a fixing member capable of fixing the end portion of the FFC to the holder. The fixing member includes: an annular portion into which the placing plate of the holder with the end portion of the FFC placed thereon, is inserted together with the FFC; and engagement portions which are engageable with corresponding engaged portions of the holder when the annular portion is brought toward the holder with the FFC previously inserted into the annular portion.

7 Claims, 13 Drawing Sheets

PLUG-TYPE CONNECTOR AND ELECTRIC CONNECTOR COMPRISING THE SAME

BACKGROUND OF THE INVENTION

1. Field of the Invention

The present invention relates to a plug-type connector for connecting an FFC (Flexible Flat Cable), and an electric connector comprising such a plug-type connector.

2. Description of Related Art

Conventionally, an FPC (Flexible Printed Circuit) in the form of a flexible printed circuit board is connected to a base board by connecting a plug-type connector connected to an end of the FPC, to a receptacle-type base connector fixed to the base board.

For example, in a plug-type connector disclosed in Japanese Unexamined Patent Publication No. 11-329619 (1999), a plug housing is formed by a pair of mutually divided sandwiching members, which are connected to each other with an end of an FPC held by and between these sandwiching members. A fixing pin at one sandwiching member passes through a through-hole formed in the FPC at its widthwise intermediate position. This fixing pin is fitted to the other sandwiching member such that the FPC is securely held in the plug housing.

Generally, an FFC is smaller in the degree of freedom as to the conductor layout as compared with an FPC. Accordingly, it is difficult to form, in the FFC at its widthwise intermediate position, a through-hole or the like for a fixing pin as above-mentioned. That is, the plug-type connector disclosed in the above-mentioned Publication can hardly be applied to FFC connection.

If the plug-type connector disclosed in the above-mentioned Publication is applied to FFC connection with no fixing pin used, this involves the likelihood that the FFC is unstably held due to variations of dimensional precision and combination precision of the sandwiching members, and the like.

SUMMARY OF THE INVENTION

It is an object of the present invention to provide a plug-type connector which is not only capable of readily connecting an FFC but also capable of securely holding the FFC, and also to provide an electric connector comprising such a plug-type connector.

A plug-type connector of the present invention is a connector for connecting an FFC, and comprises: a holder including a placing plate on which an end portion of the FFC is placed as temporarily held; and a fixing member capable of fixing the end portion of the FFC to the holder. The fixing member comprises: an annular portion into which the placing plate of the holder with the end portion of the FFC placed thereon, is inserted together with the FFC; and engagement portions which are engageable with corresponding engaged portions of the holder when the annular portion is brought toward the holder with the FFC previously inserted into the annular portion.

According to the present invention, with the FFC end portion temporarily held by the placing plate of the holder, the FFC end portion and the placing plate are fitted into the annular portion of the fixing member such that the engagement portions of the fixing member engage with the engaged portions of the holder. Thus, the FFC can readily be connected to the plug-type connector. When an FFC is held by and between two sandwiching members connected to each other as conventionally done, this involves the likelihood that the FFC is unstably held due to variations of dimensional precision and combination precision of the sandwiching members. On the other hand, the present invention uses the fixing member having the annular portion, thus enabling the FFC to be stably held.

A reinforcing sheet for holding exposed conductors in a row, may be attached to the backside of the end portion of the FFC. In such a case, a pulling-out preventing projection engageable with an edge portion of the reinforcing sheet of the FFC, is preferably formed on the placing face of the placing plate of the holder. According to the arrangement mentioned above, before the fixing member is mounted, the FFC can be temporarily held with its end portion placed on the placing plate of the holder. This improves the working efficiency of connecting the FFC to the plug-type connector. Further, such improvement can be achieved by a simple structure utilizing the reinforcing sheet of the FFC. Further, provision is made such that the FFC is prevented from being pulled out after assembled. The pulling-out preventing projection fulfills its function as far as it can engage with the thin reinforcing sheet. Accordingly, the projecting amount may be small. Thus, the plug-type connector can be made low in height.

Preferably, positioning projections engageable with concaved grooves formed in the lateral edges of the end portion of the FFC, are formed on the placing face of the placing plate of the holder. According to the arrangement above-mentioned, the precision of positioning the FFC with respect to the placing plate of the holder can be improved. This also contributes to prevention of the FFC from being pulled out.

Preferably, a wrong-side insertion preventing portion is formed on the backside of the placing face of the placing plate for preventing the fixing member from being inversely assembled with the placing plate. This arrangement securely prevents the fixing member from being inversely assembled. Further, it is not required to pay special attention to the assembling work, thus improving the working efficiency.

The holder may comprise, on the placing plate, a pair of holding frames for defining grooves into which a pair of lateral edges of the FFC end portion can be introduced, respectively. According to such an arrangement, the fixing member may comprise a pair of projection portions which project from the annular portion to come in contact with the corresponding holding frames of the holder, the engagement portions may be formed on the projection portions, and the holding frames and the projection portions may form a part of an insertion projecting portion to be inserted into an insertion concave of a counter-connector. According to the arrangement above-mentioned, the holding frames of the holder and the projection portions of the fixing member, form a part of the insertion projecting portion, which is inserted into the insertion concave of a mating connector. This assures a secure connector connection. Further, the holding frames and the projection portions not only serve as the insertion projecting portion, but are also utilized for defining the grooves and forming the engagement portions. Thus, the holding frames and the projection portions can fulfill a plurality of functions even though they have a simple structure.

An electric connector of the present invention comprises: a plug-type connector having the features above-mentioned; and a receptacle-type connector combined with the plug-type connector. The receptacle-type connector comprises: a housing having an insertion concave into which the insertion projecting portion of the plug-type connector, is inserted; and a plurality of contacts arranged side by side in the insertion concave. The present invention can provide an electric connector ideal for connection of an FFC to a board when used with the receptacle-type connector attached to the board.

These and other features, objects and advantages of the present invention will be more fully apparent from the following detailed description set forth below when taken in conjunction with the accompanying drawings.

DESCRIPTION OF THE PREFERRED EMBODIMENTS

Figure 1:
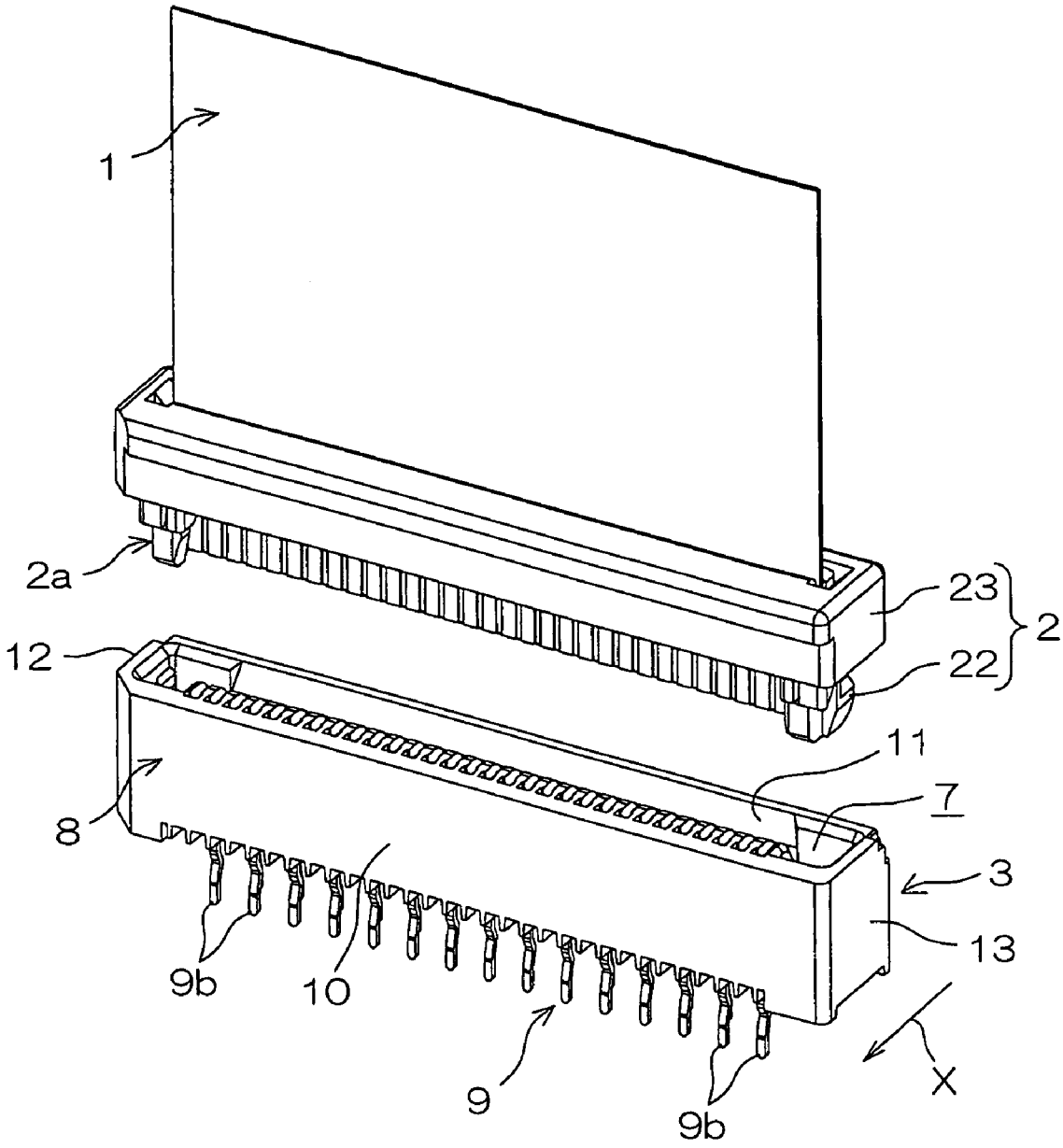
FIG. 1 is an exploded perspective view of a base connector and a plug-type connector according to an embodiment of the present invention.
Figure 2:
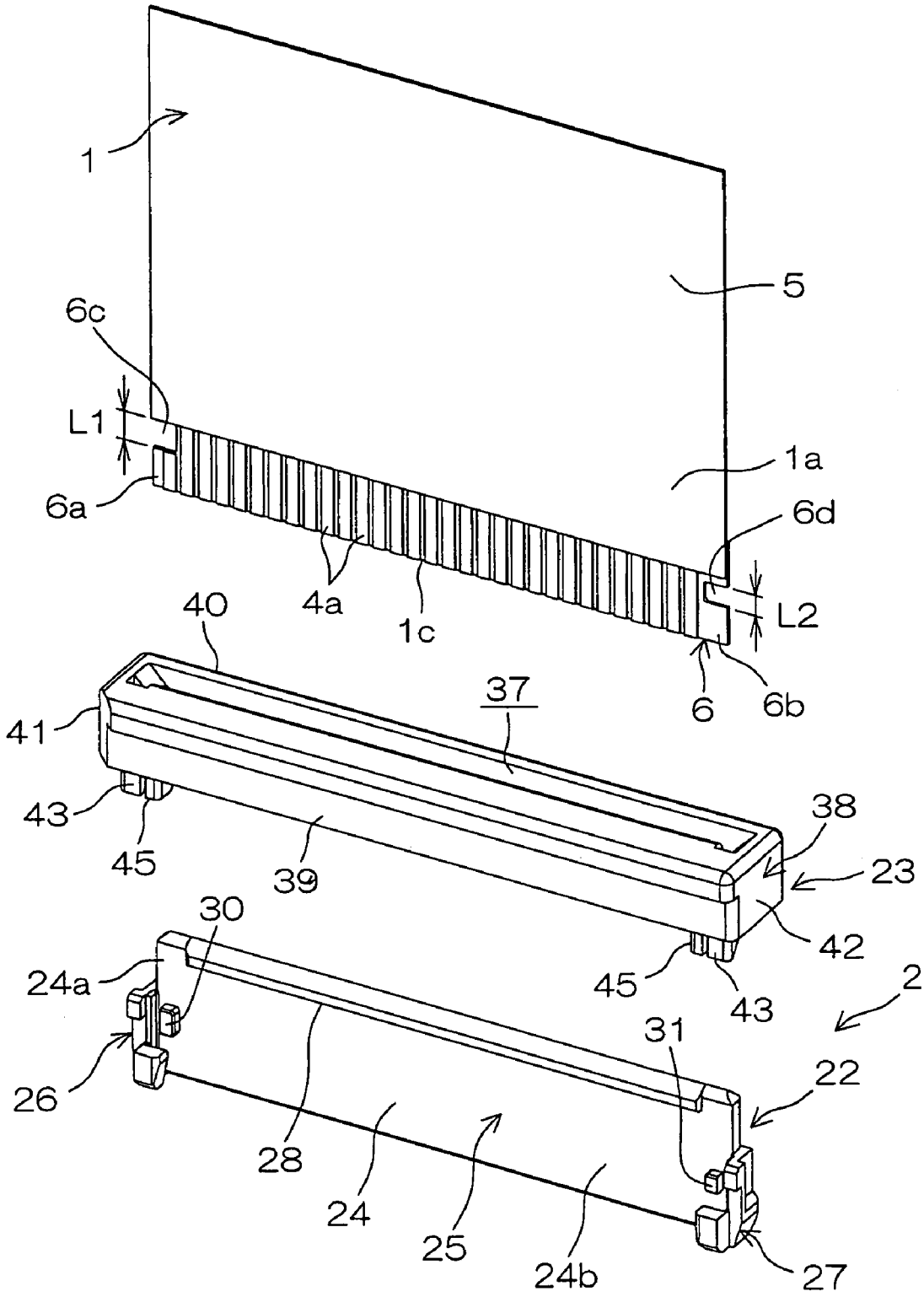
FIG. 2 is an exploded perspective view of the plug-type connector and an FFC.

FIG. 1 is an exploded perspective view of (i) a plug-type connector 2, according to an embodiment of the present invention, to which an FFC 1 is connected, and (ii) a base connector 3 serving as a receptacle-type connector. FIG. 2 is an exploded perspective view of the FFC 1 and the plug-type connector 2, and FIG. 3 is a section view of the FFC 1.

Figure 3:
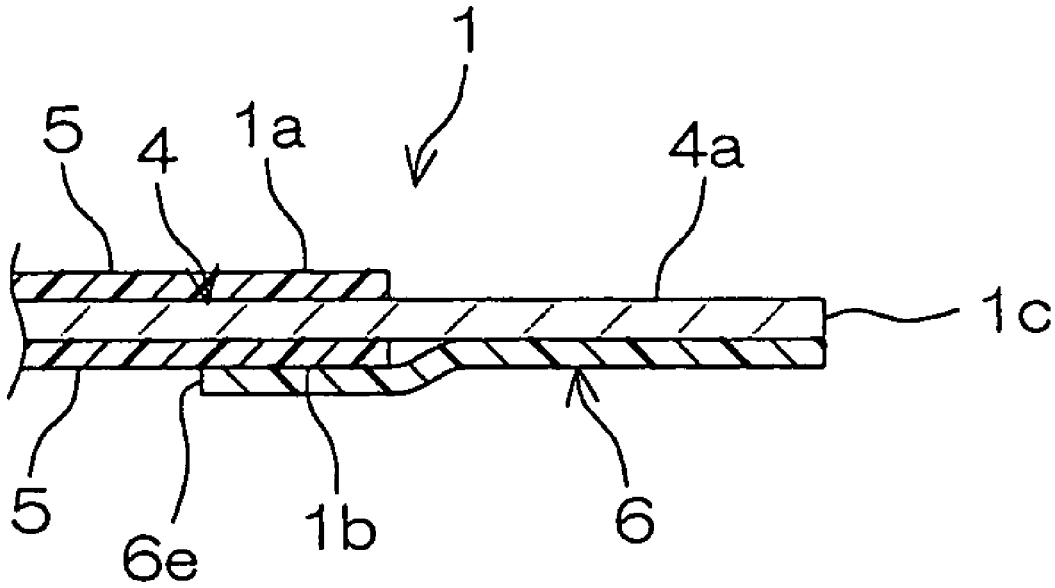
FIG. 3 is a schematic section view of the FFC.

Referring to FIGS. 2 and 3, the FFC 1 comprises a number of conductors 4 arranged side by side and insulating films 5 laminated on the both sides of the conductors 4. A synthetic resin reinforcing sheet 6 is attached to the backside 1*b* of an end portion 1*a* of the FFC 1. The reinforcing sheet 6 aligns and holds exposed conductors 4*a* extending from the end portion 1*a* of the FFC 1. Referring to FIG. 2, the reinforcing sheet 6 is provided in a pair of lateral edges 6*a*, 6*b* thereof with first and second concaved grooves 6*c*, 6*d*. Each of the concaved grooves 6*c*, 6*d* is substantially rectangular for example. Provision is made such that the widths L1, L2 of the first and second concaved grooves 6*c*, 6*d* are different from each other with respect to the longitudinal direction of the FFC 1.

Figure 5:
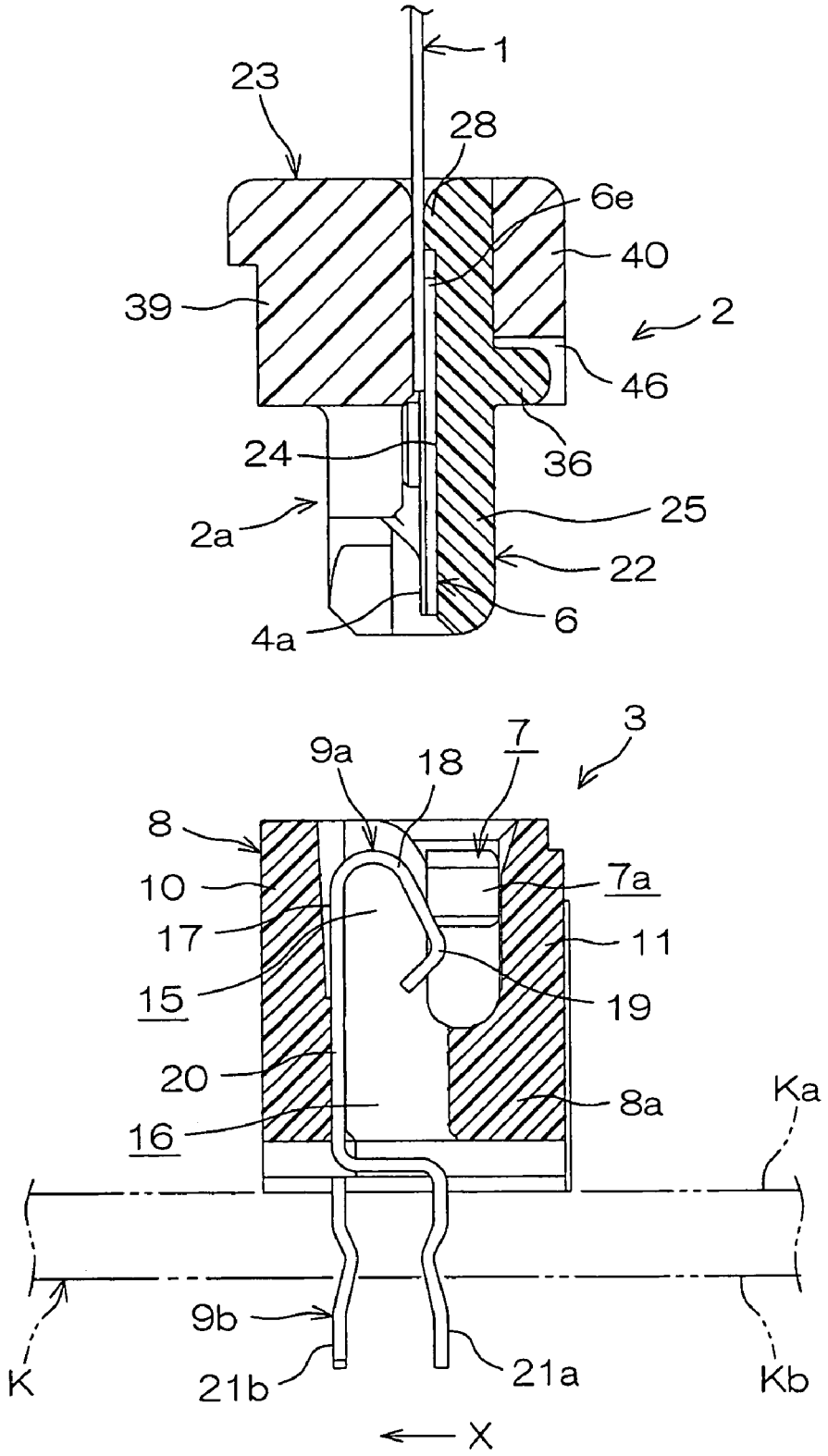
FIG. 5 is an exploded section view of the plug-type connector and the base connector.

Referring to FIGS. 1 and 5, the base connector 3 comprises: a base housing 8 which defines an insertion concave 7, which is made of an insulating synthetic resin, and which is attached to the surface Ka of a board K; and a contact row 9 having contacts 9*a*, 9*b* which pass through the base housing 8 and which are alternately disposed side by side.

Figure 4:
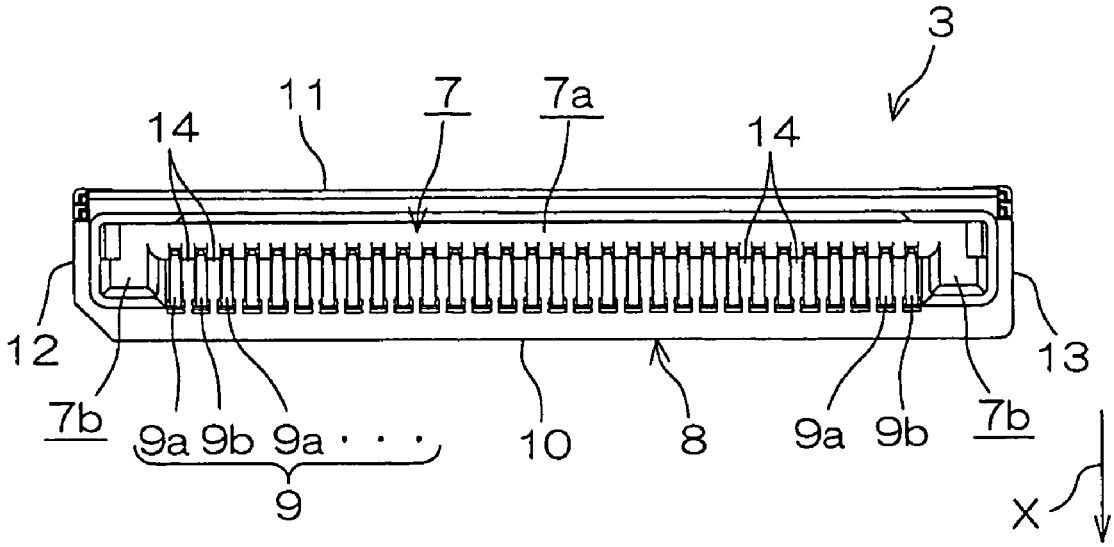
FIG. 4 is a schematic plan view of the base connector.

Referring to FIGS. 1 and 4, the base housing 8 has first and second walls 10, 11 opposite to each other, and a pair of lateral walls 12, 13 which connect the opposite ends of the first and second walls 10, 11 to each other. These walls 10 to 13 define the insertion concave 7. For convenience's sake, the side of the base connector 3 at which the first wall 10 is disposed, is referred to as the front side X.

Referring to FIG. 4, the insertion concave 7 has a first concave 7*a* along the second wall 11, and a pair of second concaves 7*b* which communicate with both ends of the first concave 7*a* and which extend along the lateral walls 12, 13.

Referring to FIGS. 4 and 5, a plurality of partition walls 14 in the form of a rib of comb teeth are disposed side by side at the first wall 10 defining the insertion concave 7. The partition walls 14 extend into the first concave 7*a* of the insertion concave 7. Contact holding grooves 15 which hold corresponding contacts 9*a*, 9*b*, are formed between adjacent partition walls 14. The contact holding grooves 15 are opened in the first concave 7*a* of the insertion concave 7.

Referring to FIG. 5, contact holding holes 16 which hold corresponding contacts 9*a*, 9*b*, are formed in the bottom 8*a* of the base housing 8 at the lower part of the insertion concave 7. The contact holding holes 16 communicate with corresponding contact holding grooves 15.

Each contact 9*a* has a long main body 17 housed in a contact holding groove 15, and a projecting portion 18 turned down from the tip of the main body 17 and curved in the form of a mountain. The top of the projecting portion 18 forms a contact portion 19 entering inside of the first concave 7*a* of the insertion concave 7. Further, each contact 9*a* comprises: a press-fitting portion 20 which extends from the main body 17 and which is pressed in a contact holding hole 16; and a lead 21*a* which extends from the press-fitting portion 20 and which downwardly projects from the base housing 8.

The alternately disposed contacts 9*a*, 9*b* have leads 21*a*, 21*b* different from each other only in shape. Each lead 21*a* is made in the form of a hook, while each lead 21*b* extends substantially straight from the press-fitting portion 20. Accordingly, the leads 21*a*, 21*b* are disposed in a zigzag manner with their positions alternately shifted back and forth. The leads 21*a*, 21*b* pass through the board K and are soldered on the backside Kb thereof.

Referring to FIGS. 1 and 2, the plug-type connector 2 has a holder 22 for holding the end portion 1*a* of the FFC 1, and a fixing member 23 for fixing the FFC 1 to the holder 22.

Figure 6A:
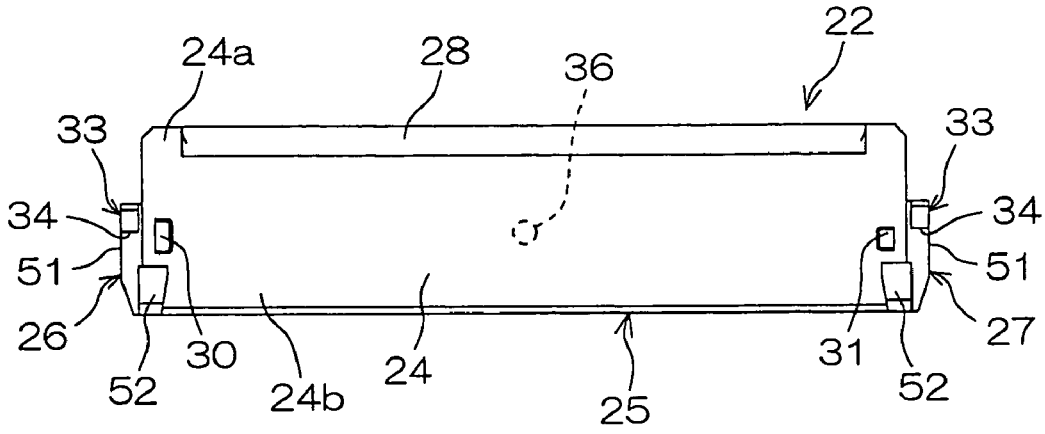
FIG. 6(*a*) is a plan view of a holder, and FIG. 6(*b*) is a front view of the holder.
Figure 6B:
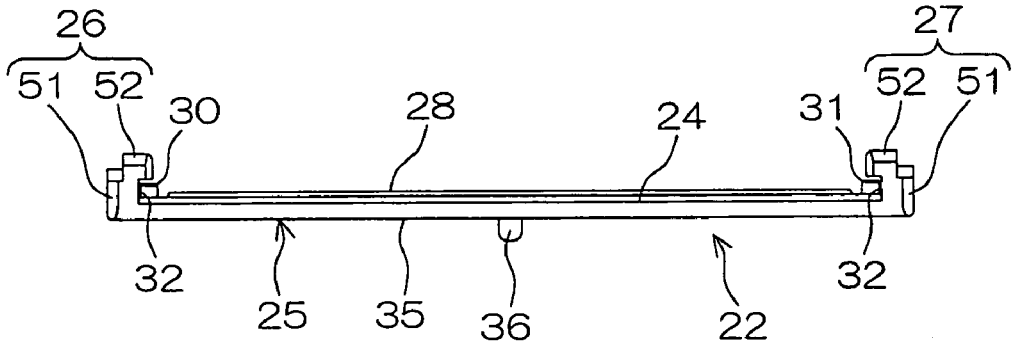
Figure 7:
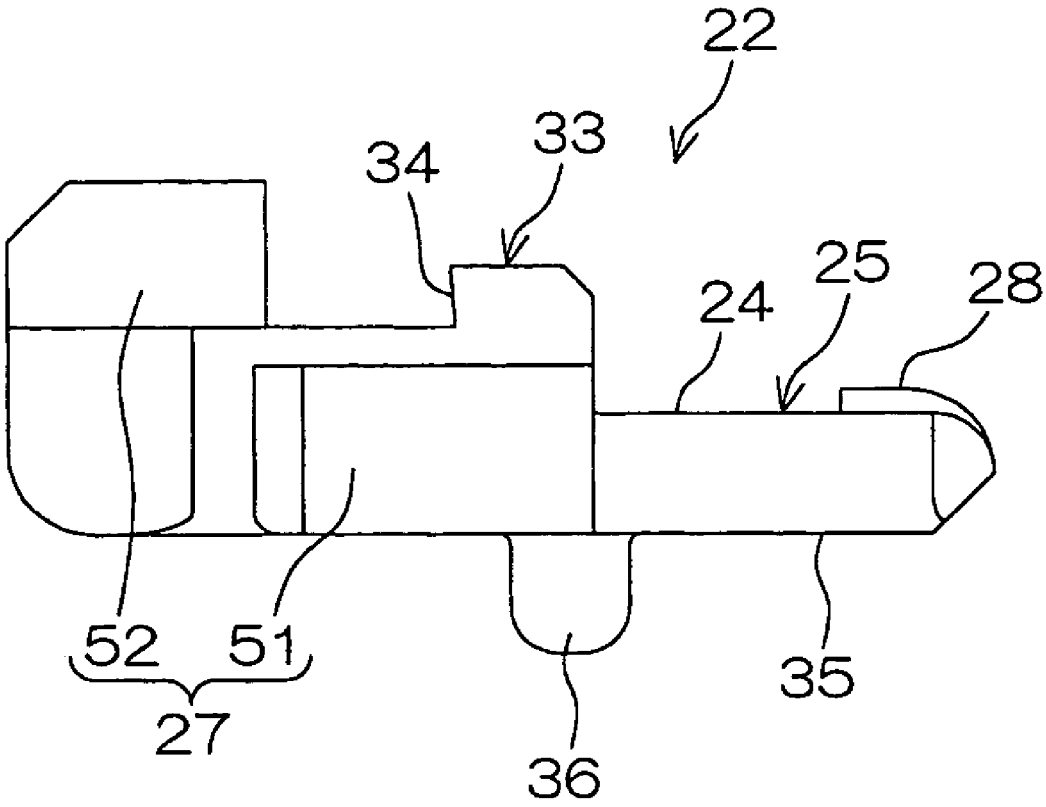
FIG. 7 is a side view of the holder.

Referring to FIGS. 2, 6(*a*), 6(*b*), 7 and 12, the holder 22 comprises: a placing plate 25 having a long rectangular placing face 24 on which the end portion 1*a* of the FFC 1 can temporarily be held and placed; and a pair of holding frames 26, 27 disposed at the placing plate 25 at the front side thereof.

Referring to FIGS. 2 and 6(*a*), a pulling-out preventing projection 28 is formed on the placing face 24 at the rear edge portion 24*a* thereof. As shown in FIGS. 3 and 5, the pulling-out preventing projection 28 is engaged with a rear edge portion 6*e* of the reinforcing sheet 6 of the FFC 1 placed on the placing face 24, thus preventing the FFC 1 from being pulled out.

As the pulling-out preventing projection 28, a single long pulling-out preventing projection may be disposed as shown in FIG. 6(*a*), or a plurality of pulling-out preventing projections 28 may be disposed at regular intervals. The pulling-out preventing projection 28 fulfills its function as far as it can engage with the reinforcing sheet 6. Accordingly, the projecting amount may be very small (for example, about 0.2 mm).

The placing face 24 is provided at both lateral sides thereof with positioning projections 30, 31 engageable with the concaved grooves 6*c*, 6*d* (See FIG. 2) of the FFC 1. The positioning projections 30, 31 have such proper widths as to be just fitted into the concaved grooves 6*c*, 6*d*, respectively. This prevents the wrong side of the FFC 1 from being placed on the placing face 24.

Referring to FIGS. 6(*a*), 6(*b*) and 12, the pair of holding frames 26, 27 have lateral frames 51 standing from the lateral edges of the placing plate 25, and upper frames 52 inwardly extending from the upper front portions of the lateral frames 51. As shown in FIG. 6(*b*), the upper frames 52, the lateral frames 51 and the placing plate 25 define grooves 32 into which the lateral edges of the end portion 1*a* of the FFC 1 can be introduced.

Referring to FIGS. 6(*a*), 6(*b*) and 7, projections 33 are formed at the upper rear portions of the lateral frames 51. The projections 33 comprise engaged portions 34 with which hooks serving as engagement portions of the fixing member 23 to be discussed later, are engaged.

Referring to FIGS. 6(*a*), 6(*b*), 7 and 12, a wrong-side insertion preventing projection 36 is formed substantially at the center of the backside 35 at the opposite side of the placing face 24 of the placing plate 25. This wrong-side insertion preventing projection 36 prevents the holder 22 from being inversely inserted into the fixing member 23.

Figure 8:
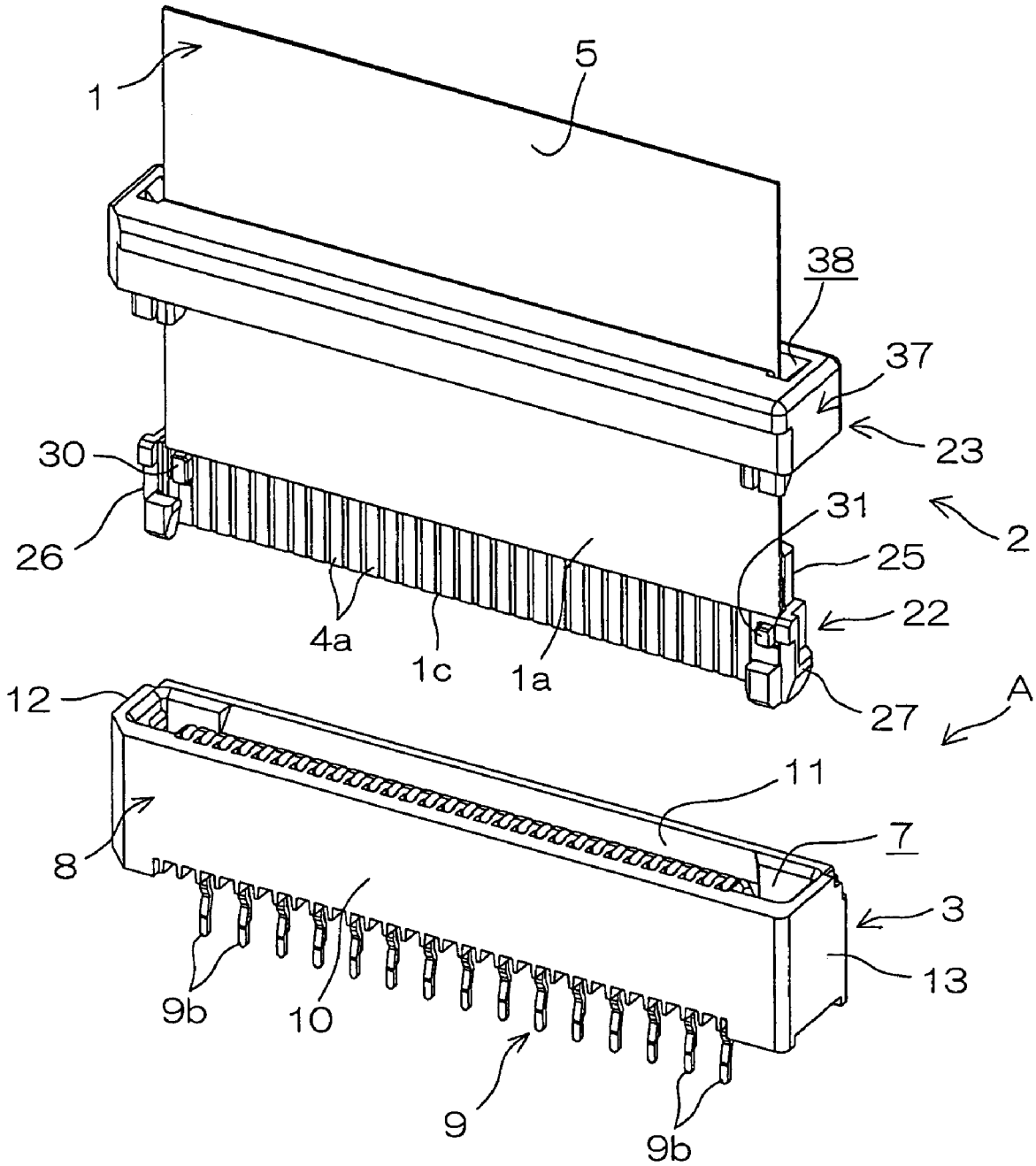
FIG. 8 is an exploded perspective view of the base connector and the plug-type connector in the course of assembling.
Figure 9A:
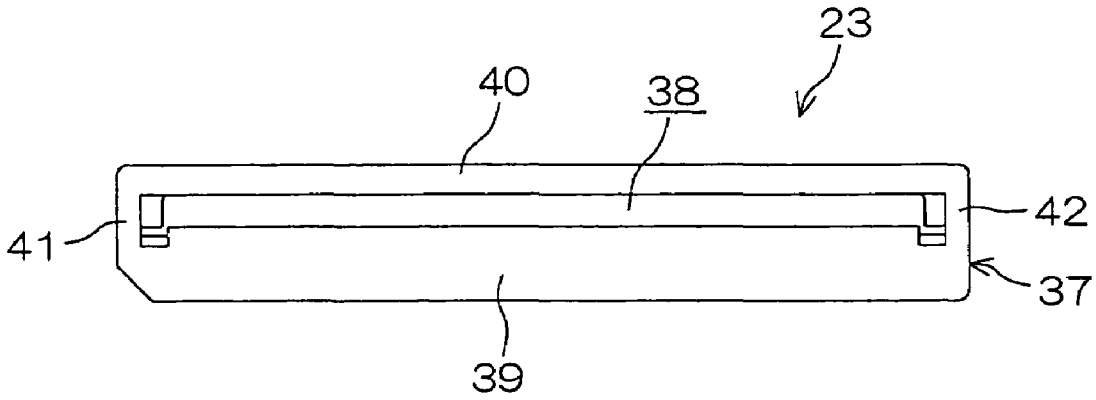
FIG. 9(*a*) is a plan view of a fixing member and FIG. 9(*b*) is a front view of the fixing member.
Figure 9B:
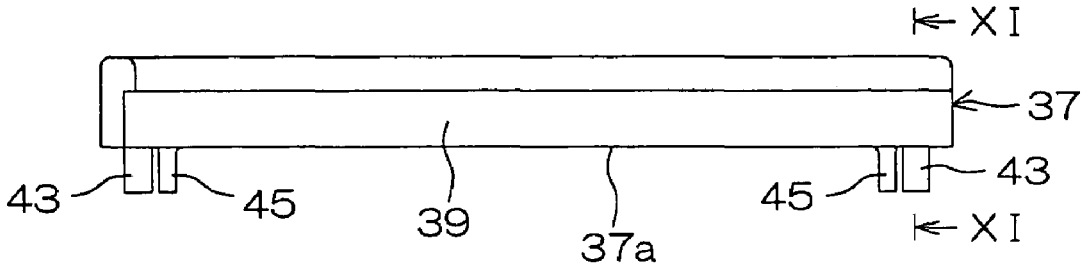

Referring to FIGS. 2, 9(*a*), 9(*b*) and 10–12, the fixing member 23 has an annular portion 37. As shown in FIG. 8, the annular portion 37 defines a substantially rectangular insertion hole 38 in which the placing plate 25 of the holder 22 with the end portion 1*a* of the FFC 1 placed thereon, can be inserted together with the FFC 1.

Referring to FIGS. 9(*a*) and 9(*b*), the annular portion 37 has: first and second walls 39, 40 respectively corresponding to the placing face 24 and the backside 35 of the placing plate 25 of the holder 22; and a pair of lateral walls 41, 42 which connect the opposite ends of the first and second walls 39, 40. These walls 39 to 42 define the insertion hole 38.

Figure 10:
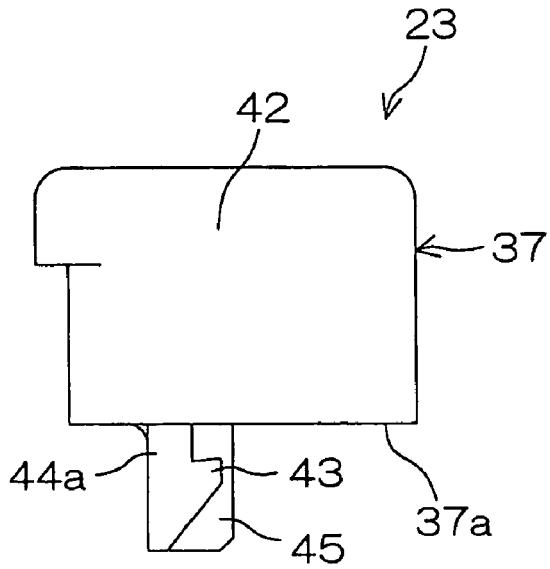
FIG. 10 is a side view of the fixing member.
Figure 11:
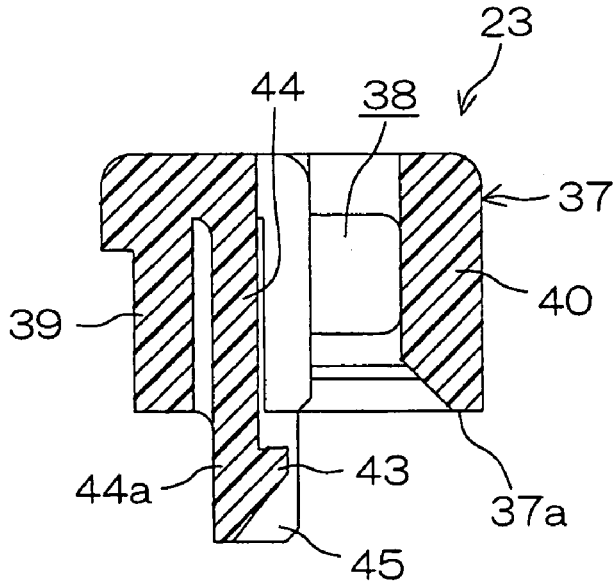
FIG. 11 is a section view taken along the line XI—XI in FIG. 9(*b*)

A pair of engagement portions 43 comprising hooks engageable with the engaged portions 34 of the pair of projections 33 of the holder 22, project from a connection-side end face 37*a* of the annular portion 37. As shown in FIGS. 10 and 11 which is a section view taken along the line XI—XI in FIG. 9(*b*), cantilevered resilient pieces 44 are formed inside of the first wall 39, and the engagement portions 43 comprising hooks are formed at the ends of those projection portions 44*a* of the resilient pieces 44 which project from the annular portion 37.

Referring to FIGS. 9(*a*), 9(*b*) and 10–12, in the vicinity of the inner sides of the pair of engagement portions 43, a pair of positioning projections 45 project from the connection-side end face 37*a* of the annular portion 37.

Figure 12:
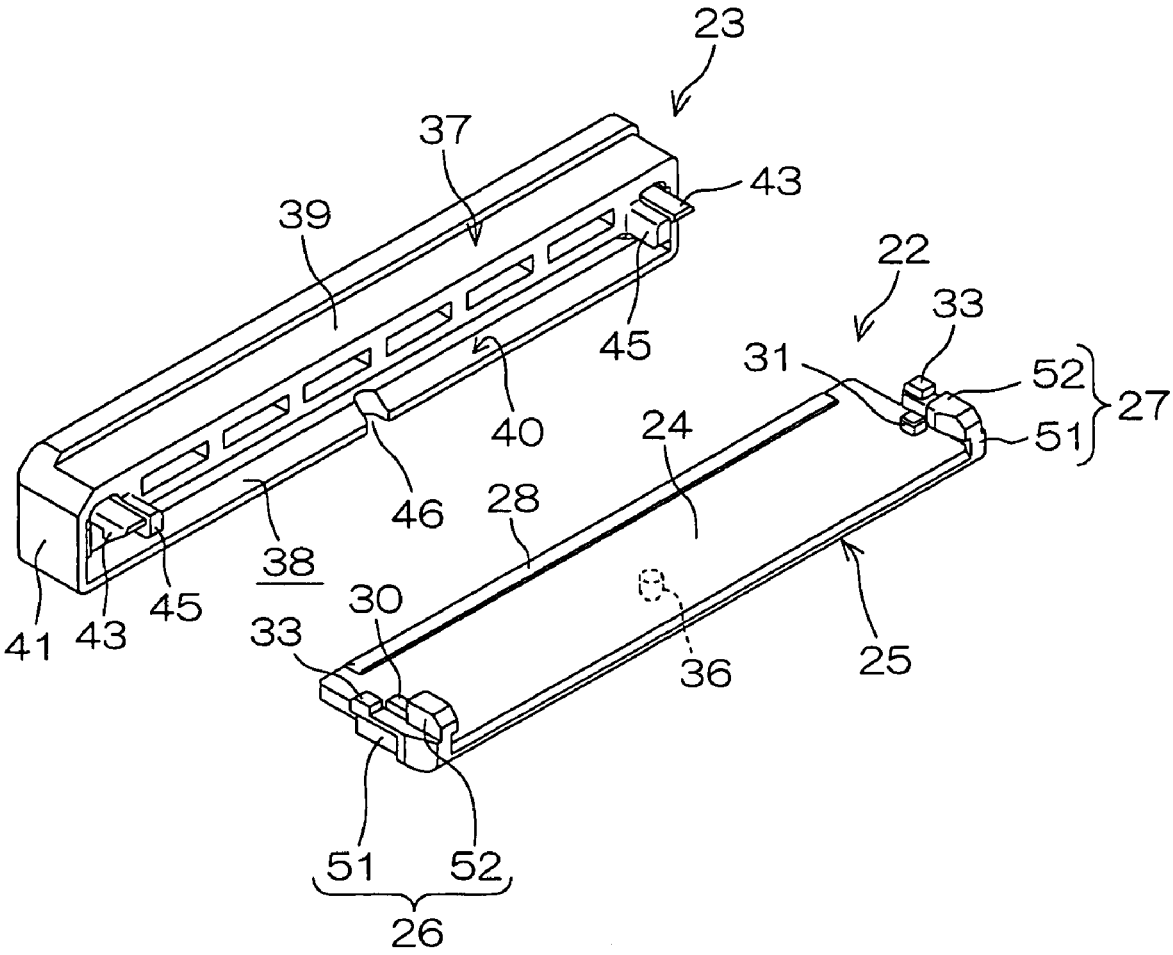
FIG. 12 is an exploded perspective view of the holder and the fixing member.
Figure 13:
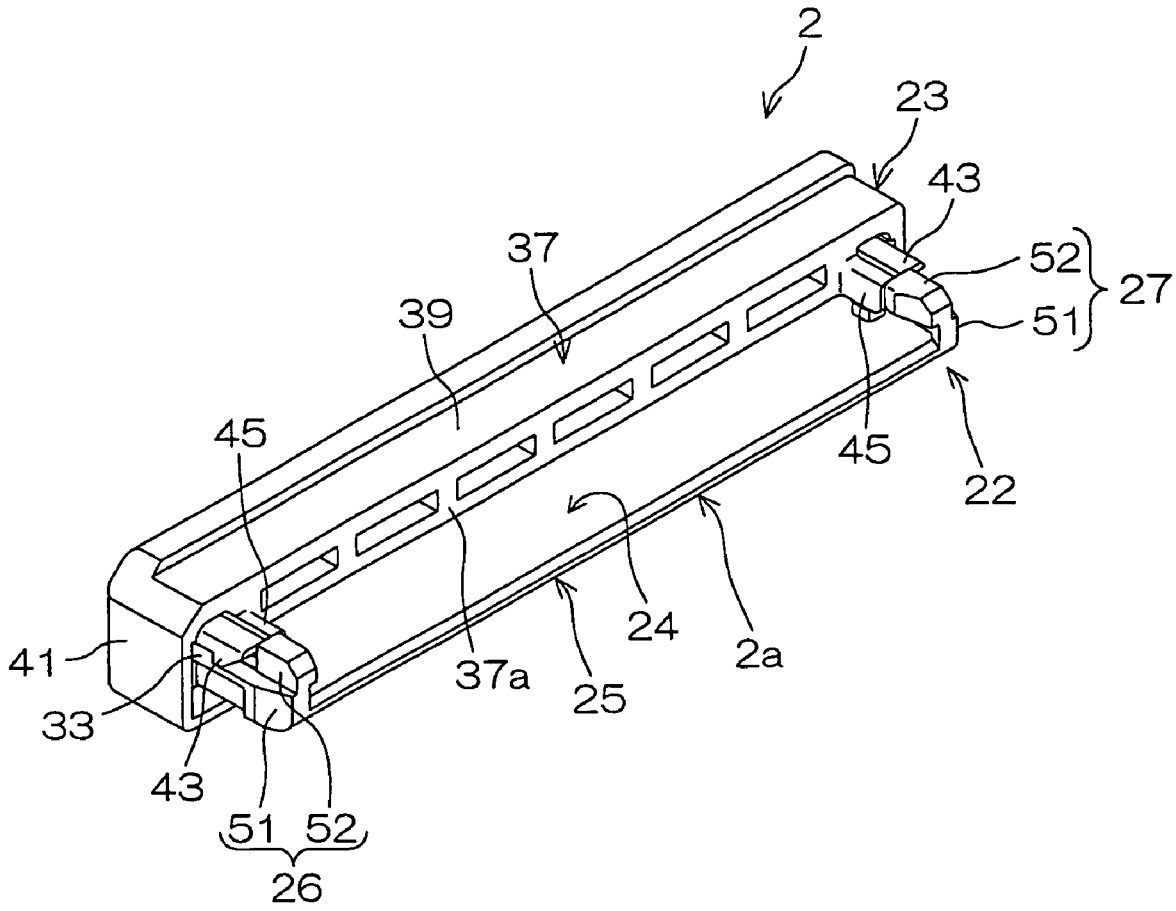
FIG. 13 is a schematic perspective view of the plug-type connector in which the holder and the fixing member are being assembled with each other.

Referring to FIGS. 12 and 13, the rear part of the holder 22 is inserted into the insertion hole 38 of the annular portion 37 of the fixing member 23, and the engagement portions 43 of the fixing member 23 get over the projections 33 of the holder 22 and then engage with the engaged portions 34. Thus, the fixing member 23 and the holder 22 are joined to each other to form a plug-type connector 2.

As shown in FIG. 12, when the holder 22 and the fixing member 23 properly face each other, the wrong-side insertion preventing projection 36 of the holder 22 can be inserted into a concaved groove 46 formed substantially in the center of the end of the second wall 40 of the fixing member 23. Accordingly, the holder 22 and the fixing member 23 can be joined to each other. On the other hand, when the holder 22 and the fixing member 23 do not properly face each other, the wrong-side insertion preventing projection 36 comes in contact with the end face of the first wall 39 of the fixing member 23. This prevents the holder 22 and the fixing member 23 from being joined to each other.

As shown in FIG. 13, the tips of both the engagement portions 43 and the positioning projections 45 of the fixing member 23, come in contact with the upper frames 52 of the holder 22 to properly position the fixing member 23 and the holder 22.

In the assembly state of the plug-type connector 2 shown in FIG. 13, that portion of the fixing member 23 which projects forwardly from the connection-side end face 37*a* of the annular portion 37, forms an insertion projecting portion 2*a* of the plug-type connector 2. More specifically, the insertion projecting portion 2*a* includes the front part of the placing plate 25 of the holder 22, the first and second holding frames 26, 27 of the holder 22, and the engagement portions 43 and the positioning projections 45 of the fixing member 23.

Figure 14:
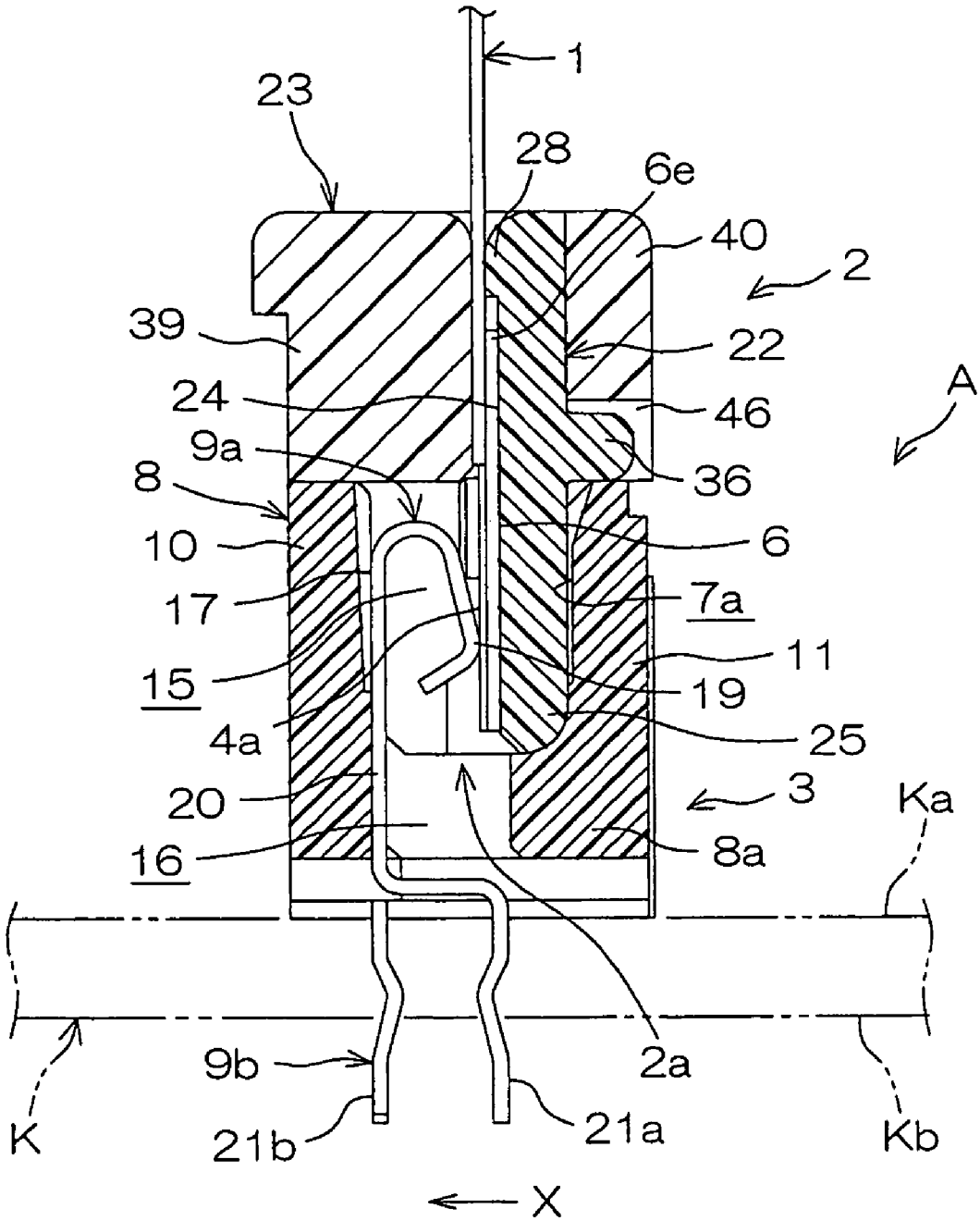
FIG. 14 is a section view of the base connector and the plug-type connector connected to each other.

This insertion projecting portion 2*a* is to be inserted into the insertion concave 7 of the base connector 3 shown in FIGS. 4 and 5. More specifically, out of the insertion projecting portion 2*a*, the front part of the placing plate 25 of the holder 22 is inserted into the first concave 7*a* (See FIG. 4) of the insertion concave 7, and the first and second holding frames 26, 27 of the holder 22 and the engagement portions 43 and the positioning projections 45 of the fixing member 23, are inserted into the corresponding second concaves 7*b* (See FIG. 4) of the insertion concave 7. Thus, as shown in FIG. 14, an electric connector A is assembled. In the electric connector A, exposed conductors 4*a* of the FFC 1 connected to the plug-type connector 2, are pressed to and contacted with the contact portions 19 of the corresponding contacts 9*a*, 9*b* of the base connector 3, thereby to achieve electric connection.

As to the connection of the plug-type connector 2 to the FFC 1, the FFC 1 is previously inserted into the annular portion 37 of the fixing member 23 such that the end portion 1*a* of the FFC 1 is temporarily held by the placing plate 25 of the holder 22 as shown in FIG. 8. At this state, the end portion 1*a* of the FFC 1 and the placing plate 25 are fitted into the annular portion 37 of the fixing member 23, and the engagement portions 43 of the fixing member 23 engage with the engaged portions 34 of the projections 33 of the holder 22 as shown in FIG. 13. In this manner, the plug-type connector 2 can readily be connected to the FFC 1 as shown in FIG. 1.

When an FFC is held by and between two sandwiching members connected to each other as conventionally done, this involves the likelihood that the FFC is unstably held due to variations of dimensional precision and combination precision of the sandwiching members. On the other hand, the present invention uses the fixing member 23 having the annular portion 37, thus enabling the FFC 1 to be stably held.

Further, as shown in FIG. 8, before the fixing member 23 is mounted, the end portion 1*a* of the FFC 1 can be temporarily held as placed on the placing plate 25 of the holder 22. This improves the working efficiency of connecting the FFC 1 to the plug-type connector 2. Further, such improvement can be achieved by a simple structure utilizing the reinforcing sheet 6 of the FFC 1. Further, provision is made such that the FFC 1 is prevented from being pulled out after assembled. The pulling-out preventing projection 28 fulfills its function as far as it can engage with the thin reinforcing sheet 6. Accordingly, the projecting amount may be small. Thus, the plug-type connector 2 can be made low in height.

Further, the positioning projections 30, 31 on the placing face 24 of the placing plate 25 of the holder 22 are engaged with the concaved grooves 6*c*, 6*d* in the FFC 1. This improves the precision of positioning the FFC 1 with respect to the placing plate 25. This also contributes to prevention of the FFC 1 from being pulled out. Further, the concaved grooves 6*c*, 6*d* have different widths L1, L2, respectively, thus preventing the FFC 1 from being inversely placed on the placing plate 25.

Further, the wrong-side insertion preventing projection 36 securely prevents the fixing member 23 from being inversely assembled with the holder 22. It is therefore not required to pay special attention to prevention of inverse assembling, thus improving the working efficiency.

The present invention should not be limited to the embodiments mentioned above. For example, one or more positioning projections (not shown) for positioning the front end of the FFC 1, may be disposed along the front edge portion 24*b* (See FIG. 6(*a*)) of the placing face 24.

Further, the first and second concaved grooves 6*c*, 6*d* of the reinforcing sheet 6 of the FFC 1 may be eliminated, and the positioning projections 30, 31 of the holder 22 may also be eliminated.

The present invention may be applied to an electric connector of the side type in which the FFC 1 is inserted transversely along the surface of a printed board, instead of the type in which the FFC 1 is inserted from above the printed board.

Embodiments of the present invention have been discussed in detail, but these embodiments are mere specific examples for clarifying the technical contents of the present invention. Therefore, the present invention should not be construed as limited to these specific examples. The spirit and scope of the present invention are limited only by the appended claims.

This Application corresponds to Japanese Patent Application No. 2003-164056 filed with the Japanese Patent Office on Jun. 9, 2003, the full disclosure of which is incorporated hereby by reference.

We claim:

1. A plug-type connector for connecting an FFC having a laterally-extending cable width, comprising:

a holder including a placing plate on which an end portion of the FFC is placed as temporarily held; and a fixing member capable of fixing the end portion of the FFC to the holder, the fixing member including:

an annular portion into which the placing plate of the holder with the end portion of the FFC placed thereon, is inserted together with the FFC; and a pair of engagement portions which are engageable with corresponding ones of a pair of engaged portions of the holder when the annular portion is brought toward the holder with the FFC previously inserted into the annular portion, engaged ones of the engagement portions and the corresponding engaged portions being disposed opposite one another laterally outside of the cable width.

2. A plug-type connector according to claim 1, wherein positioning projections are formed on the placing face of the placing plate of the holder, the positioning projections being engageable with concaved grooves formed in lateral edges of the end portion of the FFC.

3. A plug-type connector according to claim 1, wherein the holder includes, on the placing plate, a pair of holding frames for defining grooves into which a pair of lateral edges of the end portion of the FFC can be introduced, respectively, the fixing member includes a pair of projection portions which project from the annular portion to come in contact with the corresponding holding frames of the holder, the engagement portions being formed on the projection portions, and the corresponding holding frames and the projection portions are combined with each other, thus forming a part of an insertion projecting portion to be inserted into an insertion concave of a mating connector.

4. A plug-type connector for connecting an FFC, comprising:

a holder including a placing plate on which an end portion of the FFC is placed as temporarily held; and a fixing member capable of fixing the end portion of the FFC to the holder, the fixing member including:

an annular portion into which the placing plate of the holder with the end portion of the FFC placed thereon, is inserted together with the FFC; and engagement portions which are engageable with corresponding engaged portions of the holder when the annular portion is brought toward the holder with the FFC previously inserted into the annular portion, wherein a reinforcing sheet is attached to a backside of the end portion of the FFC for holding exposed conductors in a row, and a pulling-out preventing projection is formed on the placing face of the placing plate of the holder, the pulling-out preventing projection being engageable with an edge portion of the reinforcing sheet of the FFC.

5. A plug-type connector for connecting an FFC, comprising:

a holder including a placing plate on which an end portion of the FFC is placed as temporarily held; and a fixing member capable of fixing the end portion of the FFC to the holder, the fixing member including:

an annular portion into which the placing plate of the holder with the end portion of the FFC placed thereon, is inserted together with the FFC; and engagement portions which are engageable with corresponding engaged portions of the holder when the annular portion is brought toward the holder with the FFC previously inserted into the annular portion, wherein a wrong-side insertion preventing portion is formed on a backside of the placing face of the placing plate for preventing the fixing member from being inversely assembled with the placing plate.

6. An electric connector provided with a plug-type connector and a receptacle-type connector combined with the plug-type connector, the plug-type connector having an insertion projecting portion to be inserted into an insertion concave of the receptacle-type connector, the receptacle-type connector including: a housing defining the insertion concave into which the insertion projecting portion of the plug-type connector is inserted; and a plurality of contacts arranged side by side in the insertion concave, the plug-type connector further including:

a holder including a placing plate on which an end portion of a FFC having a laterally-extending cable width is placed as temporarily held; and a fixing member capable of fixing the end portion of the FFC to the holder, the fixing member including:

an annular portion into which the placing plate of the holder with the end portion of the FFC placed thereon, is inserted together with the FFC; and a pair of engagement portions which are engageable with corresponding ones of a pair of engaged portions of the holder when the annular portion is brought toward the holder with the FFC previously inserted into the annular portion, engaged ones of the engagement portions and the corresponding engaged portions being disposed opposite one another laterally outside of the cable width.

7. An electric connector according to claim 6, wherein the holder includes, on the placing plate, a pair of holding frames for defining grooves into which a pair of lateral edges of the end portion of the FFC can be introduced, respectively, the fixing member includes a pair of projection portions which project from the annular portion to come in contact with the corresponding holding frames of the holder, the engagement portions being formed on the projection portions, and the corresponding holding frames and the projection portions are combined with each other, thus forming a part of the insertion projecting portion.

* * * * *